US006702428B2

(12) United States Patent
Park et al.

(10) Patent No.: US 6,702,428 B2
(45) Date of Patent: Mar. 9, 2004

(54) INK-JET PRINTHEAD

(75) Inventors: Sung-joon Park, Gyeonggi-do (KR); Seo-hyun Cho, Gyeonggi-do (KR); Sang-cheol Ko, Gyeonggi-do (KR); Jae-sik Min, Gyeonggi-do (KR); Kyong-il Kim, Gyeonggi-do (KR); Byung-ha Park, Gyeonggi-do (KR); Tae-kyun Kim, Gyeonggi-do (KR); Myung-song Jung, Gyeonggi-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/268,083

(22) Filed: Oct. 10, 2002

(65) Prior Publication Data

US 2003/0081076 A1 May 1, 2003

(30) Foreign Application Priority Data

Oct. 12, 2001 (KR) ..... 2001-62947

(51) Int. Cl.[7] ..... B41J 2/05
(52) U.S. Cl. ..... 347/56; 347/63
(58) Field of Search ..... 347/20, 56, 61, 347/63, 64, 65, 67

(56) References Cited

U.S. PATENT DOCUMENTS 6,070,969 A 6/2000 Buonanno
6,328,428 B1 * 12/2001 Keefe et al. ..... 347/63

* cited by examiner

*Primary Examiner*—Juanita Stephens
(74) *Attorney, Agent, or Firm*—Staas & Halsey LLP

(57) ABSTRACT

A bubble-jet type ink-jet printhead has a structure in which a base plate, a barrier wall, and a nozzle plate are stacked. The base plate includes a substrate on which a recess is formed to a predetermined depth, an adiabatic layer formed on the substrate, a heater which is formed on the adiabatic layer and generates a thermal energy, and a passivation layer which is formed on the heater and passivates the heater. The barrier wall is stacked on the base plate, defines an ink chamber, which is disposed on the recess and has a recessed bottom surface, and defines an ink passage which communicates with the ink chamber. The nozzle plate is stacked on the barrier wall, has nozzles through which ink is ejected, and is formed at a location corresponding to a center of the ink chamber. Since a height of the barrier wall surrounding the ink chamber is reduced by the recess, delamination caused by ink soaked into the barrier wall can be prevented, and print performances such as a traveling property in a straight direction of ink droplets and ejection velocity of ink droplets, are improved.

33 Claims, 5 Drawing Sheets

INK-JET PRINTHEAD

CROSS-REFERENCE TO RELATED APPLICATIONS

This application claims the benefit of Korean Patent Application No. 2001-62947, filed Oct. 12, 2001, in the Korean Intellectual Property Office, the disclosure of which is incorporated herein by reference.

BACKGROUND OF THE INVENTION

1. Field of the Invention

The present invention relates to a bubble-jet type ink-jet printhead, and more particularly, to a bubble-jet type ink-jet printhead having a recess formed on a substrate on which a bottom surface of an ink chamber is disposed.

2. Description of the Related Art

In general, ink-jet printheads are devices printing in a predetermined color image by ejecting a small volume of a droplet of printing ink at a desired position on a recording sheet. Ink ejection mechanisms of an ink-jet printer are largely categorized into two different types: an electro-thermal transducer type (bubble-jet type) in which a heat source is employed to form a bubble in ink to cause the ink to be ejected, and an electro-mechanical transducer type in which ink is ejected by a change in ink volume due to deformation of a piezoelectric element.

In the above-mentioned ink-jet printheads, ink is supplied to an ink chamber from an ink reservoir through an ink passage. Ink filled in the ink chamber is heated by a heating element in the ink chamber and is ejected in a droplet shape through a nozzle by a pressure of the bubble generated by the heating element.

FIG. 1 is a schematic perspective view illustrating a structure of a conventional bubble-jet type ink-jet printhead, and FIG. 2 is a cross-sectional view illustrating the conventional bubble-jet type ink-jet printhead shown in FIG. 1.

Referring to FIG. 1, the conventional bubble-jet type ink-jet printhead includes a base plate 10 formed of several different material layers stacked on a substrate 11 of FIG. 2, a barrier wall 20 which is stacked on the base plate 10 and defines an ink chamber 22 and an ink passage 26, and a nozzle plate 30 stacked on the barrier wall 20. The ink chamber 22 is filled with ink, and a heater (13 of FIG. 2) which generates the bubble in the ink by heating the ink, is provided under a bottom surface 24 of the ink chamber 22. The ink passage 26 is a path for supplying ink to the ink chamber 22 and is connected to an ink reservoir (not shown). A plurality of nozzles 32 through which ink is ejected, is formed at a location corresponding to a center of the ink chamber 22 on the nozzle plate 30.

Referring to FIG. 2, the conventional bubble-jet type ink-jet printhead having the above structure of FIG. 1 includes an adiabatic layer 12 which prevents a thermal energy generated by a heater 13 from being discharged toward the substrate 11, is formed on the substrate 11 formed of silicon. The adiabatic layer 12 is generally formed of a silicon oxide layer deposited on the substrate 11. The heater 13 which generates the bubble in the ink by heating the ink in the ink chamber 22, is formed on the adiabatic layer 12. The heater 13 is deposited by sputtering a tantalum-aluminum alloy in a thin film shape, for example. A conductor 14 transmitting a current to the heater 13 is formed on the heater 13. The conductor 14 is formed of an aluminum-copper alloy, for example.

Passivation layers 15*a* and 15*b* for passivating the heater 13 and the conductor 14 are formed on the heater thin film 13 and the conductor 14. The passivation layers 15*a* and 15*b* prevent the heater 13 and the conductor 14 from oxidizing or directly contacting ink and are formed of two layers, such as a first passivation layer 15*a* formed of a silicon nitride layer and a second passivation layer 15*b* formed of a silicon carbide layer. An anticavitation layer 16 is formed on the second passivation layer 15*b* where the ink chamber 22 is formed. The anticavitation layer 16 prevents the heater 13 from being damaged by a high atmospheric pressure generated when the bubble in the ink chamber 22 is removed, by forming the bottom surface 24 of the ink chamber 22 on an upper side of the anticavitation layer 16, and a tantalum thin film is generally used for the anticavitation layer 16.

The barrier wall 20 defines the ink chamber 22 and the ink passage 26 and is stacked on the base plate 10 that is formed of several different layers stacked on the substrate 11. The barrier wall 20 is coated through lamination for heating, pressurizing, and compressing a photosensitive polymer on the base plate 10, followed by patterning. In this case, a coating thickness of the photosensitive polymer is about between 25 $\mu$m and 35 $\mu$m and is determined by a height of the ink chamber 22 required by a volume of the ink droplet ejected.

The nozzle plate 30 on which the plurality of nozzles 32 are formed, is stacked on the barrier wall 20. The nozzle plate 30 is formed of polyimide or nickel and is heated and pressurized on the barrier wall 20 and attached to the barrier wall 20 using adhesion of the photosensitive polymer forming the barrier wall 20.

In the above structure of the conventional bubble-jet type ink-jet printhead, the photosensitive polymer forming the barrier wall 20 is used to attach the base plate 10 to the nozzle plate 30 and surrounds the ink chamber 22. Ink filled in the ink chamber 22 contains water of about between 60% and 70%, and water soaks not only into an adhesion interface among the base plate 10, the barrier wall 20, and the nozzle plate 30 but also into the photosensitive polymer forming the barrier wall 20. This phenomenon causes the delamination between elements of the ink-jet printhead and thus is a main factor in causing a defect of the ink-jet printhead.

Also, a crosstalk that affects the formation of bubbles and ejection characteristics of ink due to an atmospheric pressure applied to the adjacent ink chamber 22 through the ink passage 26 during ink ejection, may occur easily.

Also, the nozzle plate 30 adheres to the barrier wall 20 after the barrier wall 20 is formed on the base plate 10. Hence, if the height of the barrier wall 20 is large, the barrier wall 20 may be easily deformed when the nozzle plate 30 is heated and pressurized on the barrier wall 20 to be attached to the barrier wall 20. As a result, a misalignment among the nozzle 32, the ink chamber 22, and the heater 13 occurs, and thus results in poor performances of the ink-jet printhead.

SUMMARY OF THE INVENTION

To solve the above and other problems, it is an object of the present invention to provide a bubble-jet type ink-jet printhead which prevents delamination and improves ejection characteristics of ink droplets by reducing a height of a barrier wall of an ink chamber by forming a recess on a substrate on which a bottom surface of an ink chamber is disposed.

Additional objects and advantageous of the invention will be set forth in part in the description which follows and, in part, will be obvious from the description, or may be learned by practice of the invention.

Accordingly, to achieve the above and other objects, there is provided an ink-jet printhead. The ink-jet printhead includes a base plate including a substrate on which a recess is formed to a predetermined depth, an adiabatic layer formed on the substrate, a heater which is formed on the adiabatic layer and generates a thermal energy, and a passivation layer which is formed on the heater and passivates the heater, a barrier wall which is stacked on the base plate and defines an ink chamber disposed on the recess and having a recessed bottom surface and an ink passage which communicates with the ink chamber, and a nozzle plate stacked on the barrier wall and having nozzles through which ink is ejected, formed at a location corresponding to a center of the ink chamber.

Here, the recess is formed by wet or dry etching a predetermined surface of the substrate on which the ink chamber is to be formed, and a depth of the recess is between 1 $\mu$m and 20 $\mu$m, preferably, between 5 $\mu$m and 15 $\mu$m.

It is possible that the adiabatic layer is formed of a silicon oxide layer formed by oxidizing the surface of the substrate, and a thickness of the silicon oxide layer is between 1 $\mu$m and 5 $\mu$m.

It is also possible that the heater is formed of a tantalum-aluminum alloy or polysilicon, and a thickness of the heater is between 500 Å and 5,000 Å.

It is also possible that the passivation layer is formed of a silicon nitride layer deposited on the heater or two layers of a silicon nitride layer and a silicon carbide layer, which are sequentially deposited on the heater.

It is also possible that an anticavitation layer which prevents damage of the heater, is formed on the passivation layer, and that the anticavitation layer is formed of a tantalum layer.

Here, it is possible that a thickness of each of the silicon nitride layer, the silicon carbide layer, and the tantalum layer is between 0.1 $\mu$m and 1.0 $\mu$m inclusive.

Meanwhile, the barrier wall is formed of photosensitive polymer by a photolithography process. The photosensitive polymer is formed in a dry film shape and is coated on the base plate through lamination. The photosensitive polymer is coated to a thickness of between 5 $\mu$m and 24 $\mu$m on the base plate.

In addition, the nozzle plate is formed of polyimide or nickel.

According to the embodiment of the present invention, the height of the barrier wall surrounding the ink chamber is reduced more by forming the recess formed on the substrate, and thus delamination that occurs by ink soaked into the barrier wall, is prevented, and print performances, such as a traveling property in a straight direction of ink droplets and ejection velocity of ink droplets, are improved.

BRIEF DESCRIPTION OF THE DRAWINGS

These and other objects and advantageous of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
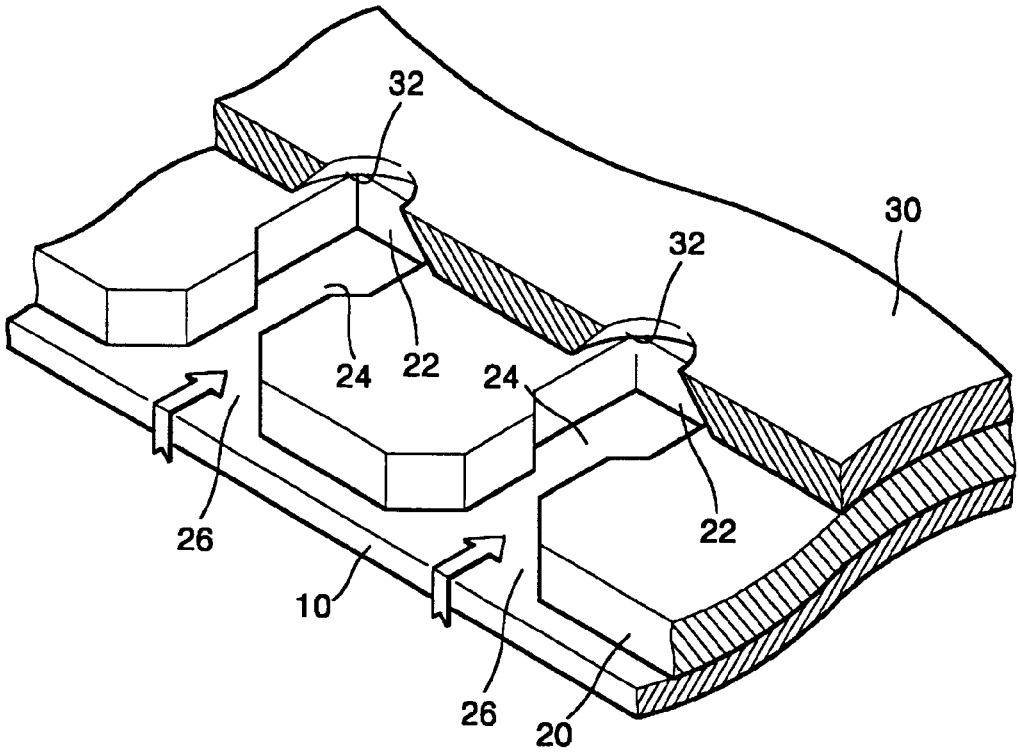
FIG. 1 (PRIOR ART)
FIG. 1 is a schematic perspective view illustrating a structure of a conventional bubble-jet type ink-jet printhead.

Reference will now be made in detail to the present preferred embodiment of the present invention, examples of which are illustrated in the accompanying drawings, wherein like reference numerals refer to the like elements throughout. The embodiment is described in order to explain the present invention by referring to the figures.

Hereinafter, the present invention will be described in detail by describing an embodiment of the invention with reference to the accompanying drawings. This invention may, however, be embodied in many different forms and should not be construed as being limited to the embodiment set forth herein. It will be understood that when a layer is referred to as being on another layer or on a substrate, it can be directly on the other layer or on the substrate, or intervening layers may also be present.

Figure 3:
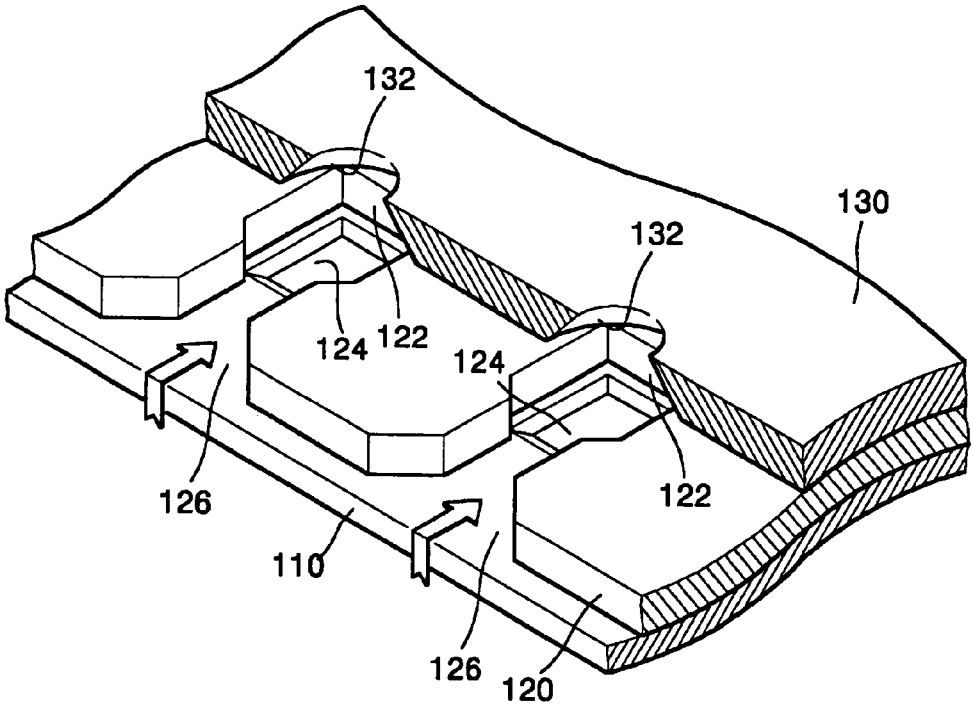
FIG. 3 is a schematic perspective view illustrating a structure of a bubble-jet type ink-jet printhead according to an embodiment of the present invention.

FIG. 3 is a schematic perspective view illustrating a bubble-jet type ink-jet printhead according to an embodiment of the present invention. Referring to FIG. 3, the bubble-jet type ink-jet printhead has a structure in which a base plate 110, a barrier wall 120, and a nozzle plate 130 are sequentially stacked. The barrier wall 120 defines an ink chamber 122 filled with ink, and an ink passage 126 which supplies ink to the ink chamber 122 from an ink reservoir (not shown). That is, the barrier wall 120 forms a sidewall surrounding the ink chamber 122 and the ink passage 126. The base plate 110 is formed of several different material layers stacked on a substrate (111 of FIG. 4), and a recessed portion defining a bottom surface 124 of the ink chamber 122 is formed on an upper side of the base plate 110 to be recessed. Consequently, a height of the barrier wall 120 surrounding (defining) the ink chamber 122 is lowered in accordance with the recessed portion, and this will be later described in detail. A plurality of nozzles 132 through which ink is ejected, are formed at a location corresponding to the ink chamber 122 on the nozzle plate 130.

Figure 4:
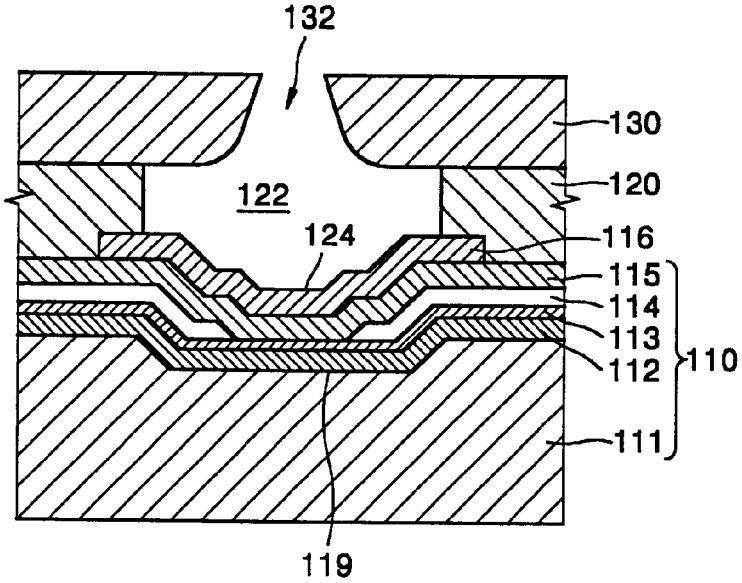
FIG. 4 is a cross-sectional view of the bubble-jet ink-jet printhead shown in FIG. 3.

A cross-sectional view of the bubble-jet type ink-jet printhead having the above structure is shown in FIG. 4.

Referring to FIG. 4, the base plate 110 is formed of several different material layers stacked on the substrate 111. Here, a silicon substrate is used for the substrate 111. This is because a silicon wafer that is widely used to manufacture semiconductor devices can be used for manufacturing the substrate 11 of the base plate 110 and thus is effective in mass production of the bubble-jet type ink-jet printhead.

A recess 119 is formed on a predetermined surface of the substrate 111, i.e., a portion where the ink chamber 122 is to be formed. An etching mask defining a region to be etched is formed on the surface of the substrate 111 in a shape corresponding to the ink chamber 122, and the region is wet etched using an etchant or dry etched using a reactive gas and plasma, thereby forming the recess 119. The recess 119 is formed to a depth of about between 1 μm and 20 μm. When the depth of the recess 119 is larger than 20 μm, it is difficult to deposit an adiabatic layer 112, a heater 113, and a passivation layer 115 on the recess 119. When the depth of the recess 119 is smaller than 1 μm, the effect of the recess 119 is not large. Thus, the recess 119 is formed to have the proper depth in the above-mentioned range according to a height of the ink chamber 122 and a thickness (height) of the barrier wall 120 that are determined in response to a volume and an ejection velocity of ink droplets ejected. It is possible that the recess 119 is formed to the depth between 5 μm and 15 μm.

Figure 6:
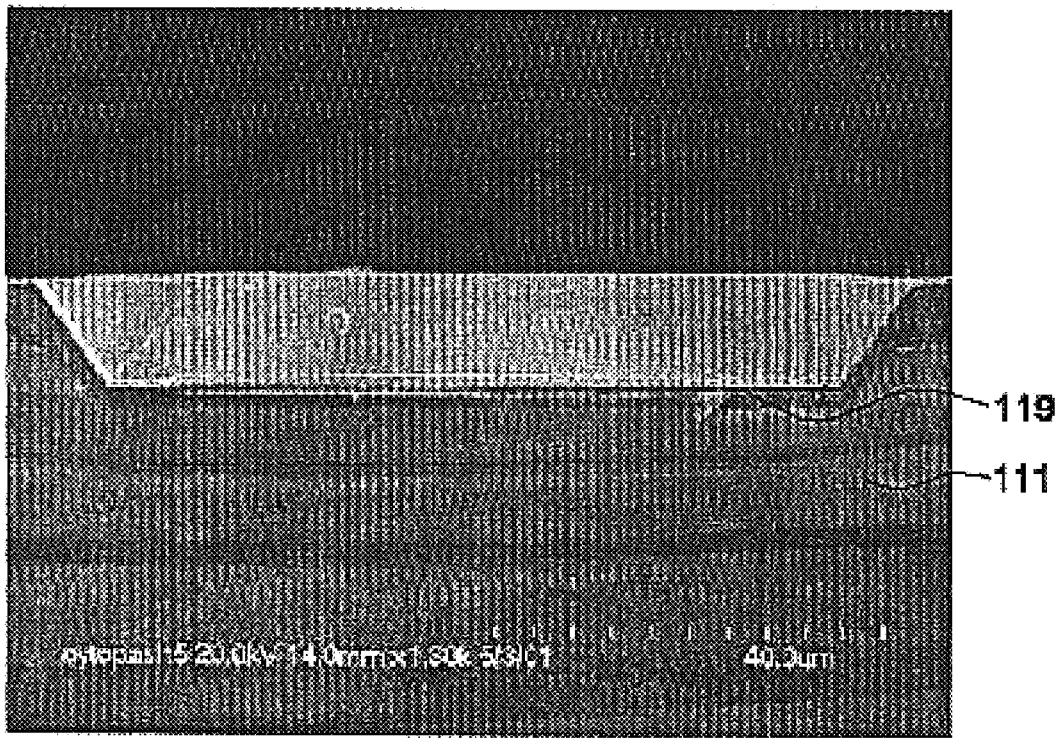
FIG. 6 is an enlarged cross-sectional photo illustrating a recess formed on a substrate of the bubble-jet type ink-jet printhead shown in FIGS. 3 and 4.
Figure 7:
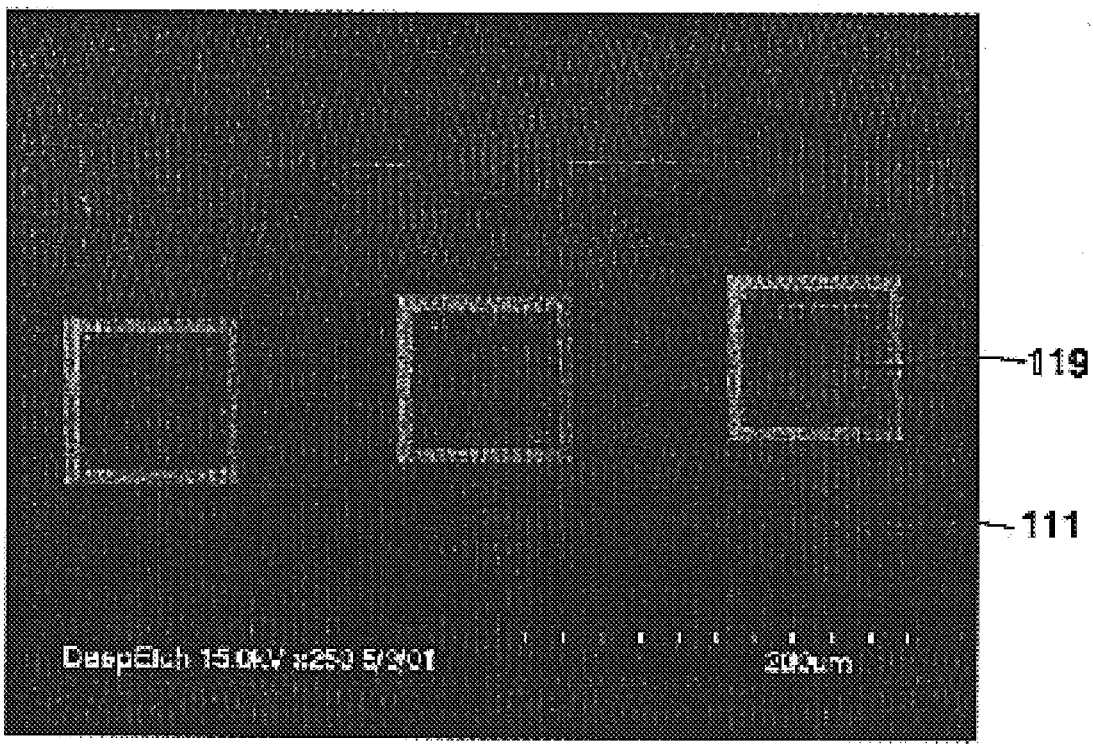
FIG. 7 is an enlarged plan photo illustrating the recess formed on the substrate of the bubble-jet type ink-jet printhead shown in FIGS. 3 and 4.

Referring to FIG. 6, the depth of the recess 119 formed on the surface of the substrate 111 is about 14 μm, and the recess 119 includes inclined sides formed between a major surface of the substrate 111 and a recessed surface recessed from the major surface of the substrate 111 by the depth. This is because different material layers can be stacked more easily on the recess 119. A plan of the recess 119 may be circular or polygonal according to a shape of a plan of the ink chamber 122. The recess 119 that is formed in a rectangular shape having each side of the length of about 130 μm, is shown in FIG. 7.

As described above, the adiabatic layer 112 which prevents a thermal energy generated by the heater 113 from being exhausted (discharged) toward the substrate 111, is formed on the major surface of the substrate 111 and the inclined sides and the recessed surface of the recess 119 of the substrate 111. It is possible that the adiabatic layer 112 is formed of a silicon oxide layer formed by oxidizing the major surface, the inclined sides, and the recessed surface of the substrate 111, and a thickness of the adiabatic layer 112 is about between 1 μm and 5 μm.

The heater 113 which generates a bubble in ink by heating ink in the ink chamber 122, is formed on the adiabatic layer 112. The heater 113, which is a resistance heating body, may be deposited by sputtering a tantalum-aluminum alloy in a thin film shape having the thickness of between 500 Å and 5,000 Å, preferably, between 500 Å and 2,000 Å, on the substrate 111. Also, the heater 113 may be formed by depositing an impurity-doped polysilicon layer on the substrate 111, followed by patterning the impurity-doped polysilicon layer. When the heater 113 is formed of polysilicon, polysilicon is deposited on the entire surface of the substrate 111 with impurities, i.e., a source gas of phosphorus (P), through low pressure chemical vapor deposition (LP CVD), and then, a deposited polysilicon layer is patterned by a photolithography process using a photomask and photoresist and by an etch process using a photoresist pattern as an etch mask.

A conductor 114 transmitting a current to the heater 113 is formed on the heater 113. The conductor 114 is formed of aluminum-copper alloy, for example.

A passivation layer 115 passivating the heater thin film 113 and the conductor 114 is formed on the heater thin film 113 and the conductor 114. The passivation layer 115 prevents the heater 113 and the conductor 114 from oxidizing or directly contacting ink and is preferably formed of a silicon nitride layer (SiN:H). The silicon nitride layer (SiN:H) is deposited to a thickness of about between 0.1 μm and 1.0 μm, preferably, between 0.3 μm and 0.7 μm, through LP CVD.

Meanwhile, the passivation layer 115 may be formed of two layers. In this case, a silicon carbide layer (SiC:H) improving a chemical resistant property is deposited to a thickness of about between 0.1 μm and 1.0 μm, preferably, between 0.3 μm and 0.7 μm, on the silicon nitride layer (SiN:H).

An anticavitation layer 116 is formed on the passivation layer 115 where the ink chamber 122 is formed. The anticavitation layer 116 prevents the heater 113 from being damaged by a high atmospheric pressure generated when the bubble in the ink chamber 122 is removed, by forming the bottom side 124 of the ink chamber 122 on the upper side of the anticavitation layer 116. It is possible that the anticavitation layer 116 is formed of a tantalum thin film having a thickness of about between 0.1 μm and 1.0 μm, preferably, between 0.3 μm and 0.7 μm.

Figure 2:
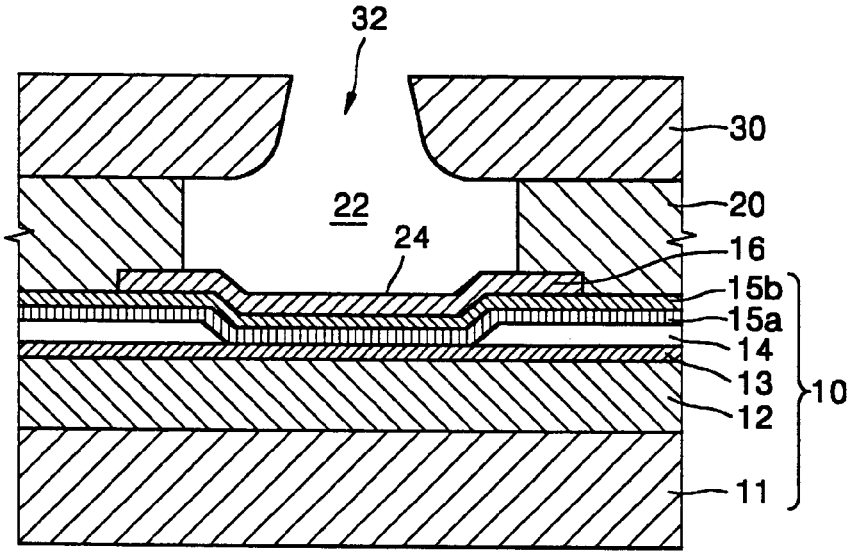
FIG. 2 (PRIOR ART)
FIG. 2 is a cross-sectional view illustrating the conventional bubble-jet type ink-jet printhead shown in FIG. 1.

As described above, the base plate 110 is formed of several different layers stacked on the substrate 111, and the upper side of the anticavitation layer 116 is recessed in accordance with the recess 119 formed on the substrate 111. Consequently, the bottom surface 124 of the ink chamber 122 is recessed to the depth of the recess 119. Thus, the height of the barrier wall 120 which is stacked on the base plate 110 and forms the ink chamber 122 and an ink passage (126 of FIG. 3), can be reduced by the depth of the recess 119. Since the bottom surface 124 of the ink chamber 122 is recessed to a predetermined depth, the same height of the ink chamber 122 as a conventional ink chamber shown in FIG. 2 can be obtained even when the height of the barrier wall 120 is lower than a conventional barrier wall shown in FIG. 2.

The barrier wall 120 is formed by a photolithography process after photosensitive polymer is coated to a predetermined thickness on the base plate 110. According to the present invention, the thickness of the barrier wall 120 is about between 5 μm and 24 μm, preferably, between 5 μm and 20 μm. The thickness (height) of the barrier wall 120 decreases by the depth of the recess 119, i.e., by a thickness of between 1 μm and 20 μm, compared with the thickness of between 25 μm and 35 μm in the conventional barrier wall of the prior art. If the height of the barrier wall 120 is smaller than the conventional barrier wall of the prior art, an amount of ink soaked into the photosensitive polymer forming the barrier wall 120 is reduced, and thus the delamination between elements of the ink-jet printhead can be prevented. In addition, if the photosensitive polymer forming the barrier wall 120 is thinner than the conventional barrier wall in the prior art, a critical dimension (CD) patterned by exposure becomes small, and thus it becomes easy to manufacture the ink-jet printhead with high resolution having a higher density.

If the photosensitive polymer forming the barrier wall 120 is exposed to light, the photosensitive polymer has a property in which a low molecular weight is changed to a high molecular weight and the photosensitive polymer is cured by a network structure formed by a high molecular chain. The uncured portion of the photosensitive polymer exists in a low molecular weight, i.e., in a monomer or oligomer state, and is easily dissolved by solvent.

The photosensitive polymer having the above property may be dry film or liquid. If the photosensitive polymer is dry film, the photosensitive polymer is coated on the base plate 110 through lamination for heating, pressurizing, and compressing the dry film. If the photosensitive polymer is liquid, the photosensitive polymer is coated on the base plate 110 through spin coating. It is possible that the photosensitive polymer formed in a dry film shape is coated through lamination. This method has an advantage that the photosensitive polymer formed in the dry film shape does not contact the bottom surface 124 of the ink chamber 122 and thus polymer or the residual of solvent does not remain in the bottom surface 124 after patterning because the bottom surface 124 of the ink chamber 122 is recessed.

If the photosensitive polymer coated on the base plate 110 is selectively exposed to the light using a photomask protecting a portion where the ink chamber 122 and the ink passage 126 are to be formed, the exposed portion is cured, and thus has a chemical resistant property and a high mechanical strength. Subsequently, the uncured portion of the photosensitive polymer is dissolved and removed using solvent, the ink chamber 122 and the ink passage 126 are formed, and simultaneously the barrier wall 120 surrounding the ink chamber 122 and the ink passage 126 are formed by the portion cured by exposure. In this case, an internal side of the barrier wall 120 is patterned to be spaced-apart from edges of the recessed portion of the bottom surface 124 of the ink chamber 122, about between 1 $\mu$m and 5 $\mu$m.

The nozzle plate 130 on which the plurality of nozzles 132 are formed, is stacked on the barrier wall 120. The nozzle plate 130 is formed of polyimide or nickel and is heated and pressurized on the barrier wall 120 to be attached to the barrier wall 120 using adhesion of the photosensitive polymer forming the barrier wall 120. In this case, since the height of the barrier wall 120 is smaller than the conventional barrier wall in the prior art, the barrier wall 120 is hardly deformed when the nozzle plate 130 is heated and pressurized on the barrier wall 120 and adheres to the barrier wall 120, and misalignment between elements caused by deformation of the barrier wall 120 can be prevented.

Figure 5:
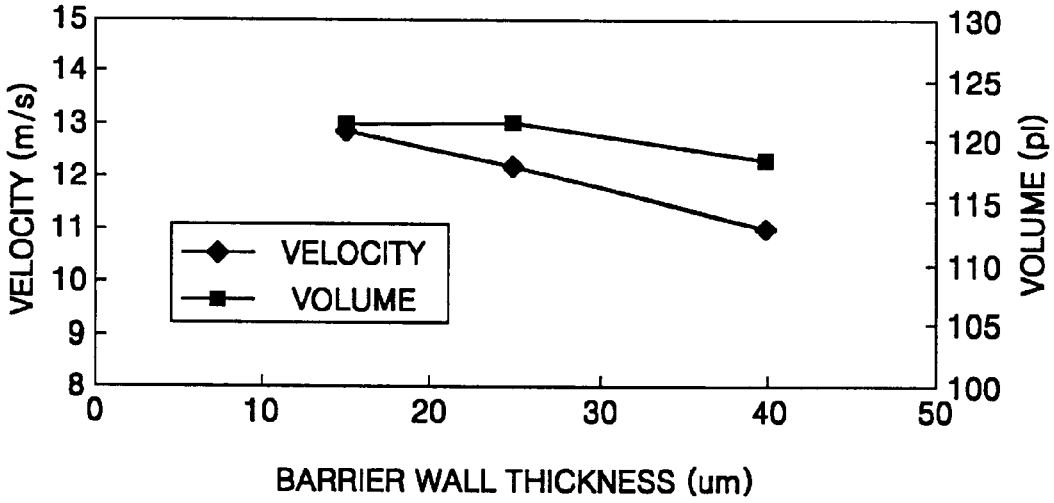
FIG. 5 is a graph illustrating variations in volume and ejection velocity of ink droplets depending on a thickness of a barrier wall surrounding an ink chamber in the bubble-jet ink-jet printhead shown in FIGS. 3 and 4.

FIG. 5 is a graph illustrating variations in volume and ejection velocity of the ink droplets depending on the thickness of the barrier wall 120 surrounding the ink chamber 122. Referring to FIG. 5, the volume of the ink droplets ejected is increased as the barrier wall 120 becomes thinner, and the ejection velocity of the ink droplets is increased as the barrier wall 120 becomes thinner on conditions that the ink droplets having more than a predetermined volume can be ejected. Since the bottom surface 124 of the ink chamber 120 is recessed, the ink chamber 122 becomes open toward the nozzles disposed on an upper portion of the ink chamber 122, a growing direction of the bubble is toward the nozzles, and thus a traveling property in a straight direction of ink droplets ejected is improved. Also, a pressure generated by the bubble moves toward the nozzles disposed on the upper portion of the ink chamber 122 according to the shape of the ink chamber 122, an orientation of the ink toward the ink passage 126 disposed on a side of the ink chamber 122 is reduced, and thus the crosstalk that affects the ink supplied to the adjacent ink chamber 122 though the ink passage 126 during ink ejection can be reduced. In this way, according to the present invention, the ejection performances of the ink droplets are improved.

As described above, the bubble-jet type ink-jet printhead according to the present invention has the following advantages.

First, the height of the barrier wall surrounding the ink chamber is smaller than the conventional barrier wall of the prior art, the delamination caused by ink soaked into the barrier wall can be reduced and prevented. In addition, the photosensitive polymer forming the barrier wall is thinner than that of the prior art, the critical dimension (CD) patterned by the exposure becomes small, and thus it becomes easy to manufacture an ink-jet printhead with the high resolution having the higher density.

Second, since the bottom surface of the ink chamber is recessed, the growing direction of the bubble is toward the nozzles, and thus the traveling property in the straight direction of the ink droplets ejected is improved, and the ejection velocity of ink droplets is improved. In addition, the crosstalk that affects the ink supplied to the adjacent ink chamber through the ink passage during ink ejection, can be reduced, and thus the ejection performances of the ink droplets are improved.

Third, since the bottom surface of the ink chamber is recessed, the photosensitive polymer formed in the film shape does not contact the bottom surface, and thus polymer or residual of solvent does not remain in the bottom surface of the ink chamber after patterning. In addition, the height of the barrier wall is smaller than that of the prior art, the deformation of the barrier wall is reduced when the nozzle plate adheres to the barrier wall, and thus the misalignment between elements can be prevented.

Although a few preferred embodiments of the present invention have been shown and described, it would be appreciated by those skilled in the art that changes may be made in this embodiment without departing from the principles and sprit of the invention, the scope of which is defined in the claims and their equivalents.

For example, other materials may be used for materials used in constituting each element of the ink-jet printhead in the present invention. That is, the substrate may be formed of another material having good processability instead of silicon. In addition, the methods of stacking materials and forming elements suggested above are provided only for illustration. Various deposition methods and etching methods may be employed within the scope of the present invention.

What is claimed is:

1. An ink-jet printhead comprising:

a base plate including a substrate on which a recess is formed to a predetermined depth, an adiabatic layer formed on the substrate, a heater which is formed on the adiabatic layer and generates a thermal energy, and a passivation layer which is formed on the heater and passivates the heater;

a barrier wall which is stacked on the base plate, defines an ink chamber disposed on the recess to have a recessed bottom surface corresponding to the recess of the substrate, and defines an ink passage which communicates with the ink chamber; and a nozzle plate stacked on the barrier wall and having nozzles through which ink is ejected, and formed at a location corresponding to a center of the ink chamber.

2. The ink-jet printhead of claim 1, wherein the recess is formed by wet or dry etching a surface of the substrate on which the ink chamber is to be formed.

3. The ink-jet printhead of claim 1, wherein the depth of the recess is between 1 $\mu$m and 20 $\mu$m inclusive.

4. The ink-jet printhead of claim 1, wherein the depth of the recess is between 5 $\mu$m and 15 $\mu$m inclusive.

5. The ink-jet printhead of claim 1, wherein the adiabatic layer is formed of a silicon oxide layer formed by oxidizing a surface of the substrate and a second surface of the substrate defining the recess.

6. The ink-jet printhead of claim 5, wherein a thickness of the silicon oxide layer is between 1 $\mu$m and 5 $\mu$m inclusive.

7. The ink-jet printhead of claim 1, wherein the heater is formed of a tantalum-aluminum alloy or polysilicon.

8. The ink-jet printhead of claim 7, wherein a thickness of the heater is between 500 Å and 5,000 Å inclusive.

9. The ink-jet printhead of claim 1, wherein the passivation layer is formed of a silicon nitride layer deposited on the heater.

10. The ink-jet printhead of claim 9, wherein a thickness of the passivation layer is between 0.1 μm and 1.0 μm inclusive.

11. The ink-jet printhead of claim 1, wherein the passivation layer is formed of a silicon nitride layer and a silicon carbide layer, which are sequentially deposited on the heater.

12. The ink-jet printhead of claim 11, wherein a thickness of each of the silicon nitride layer and the silicon carbide layer is between 0.1 μm and 1.0 μm inclusive.

13. The ink-jet printhead of claim 1, wherein the base plate comprises:

an anticavitation layer formed on the passivation layer to prevent a damage of the heater.

14. The ink-jet printhead of claim 13, wherein the anticavitation layer is formed of a tantalum layer.

15. The ink-jet printhead of claim 14, wherein the anticavitation layer has a thickness between 0.1 μm and 1.0 μm inclusive.

16. The ink-jet printhead of claim 1, wherein the barrier wall is formed of photosensitive polymer by a photolithography process.

17. The ink-jet printhead of claim 16, wherein the photosensitive polymer is coated on the base plate and has a thickness of between 5 μm and 24 μm.

18. The ink-jet printhead of claim 17, wherein the photosensitive polymer is formed in a dry film shape and coated on the base plate through lamination.

19. The ink-jet printhead of claim 1, wherein the nozzle plate is formed of polyimide or nickel.

20. An ink-jet printhead comprising:

a base plate having a recessed portion and a layer formed on the recessed portion, the layer having a first recessed surface and a second recessed surface disposed within the first recessed surface;

a barrier wall formed on a portion of the base plate other than the first and second recessed surfaces and having a sidewall to form an ink chamber with the first and second recessed surfaces; and a nozzle plate formed on the barrier wall and having a nozzle disposed on a center of the ink chamber.

21. The ink-jet printhead of claim 20, wherein the base plate comprises:

a major surface;

a first inclined surface formed between the first recessed surface and the major surface; and a second inclined surface formed between the first recessed surface and the second recessed surface.

22. The ink-jet printhead of claim 20, wherein the first recessed surface has a first depth, and the second recessed surface has a second depth.

23. The ink-jet printhead of claim 20, wherein the ink chamber has the same center as the nozzle, the first recessed surface, and the second recessed surface.

24. The ink-jet printhead of claim 20, wherein the first recessed surface and the second recessed surface comprise:

one of a circular shape and a polygonal shape.

25. An ink-jet printhead comprising:

a base plate having a first recessed surface and a second recessed surface disposed within the first recessed surface;

a barrier wall formed on a portion of the base plate other than the first and second recessed surfaces and having a sidewall to form an ink chamber with the first and second recessed surfaces; and a nozzle plate formed on the barrier wall and having a nozzle disposed on a center of the ink chamber;

wherein the barrier wall has a height between 5 μm and 24 μm inclusive.

26. An ink-jet printhead comprising:

a base plate having a first recessed surface and a second recessed surface disposed within the first recessed surface;

a barrier wall formed on a portion of the base plate other than the first and second recessed surfaces and having a sidewall to form an ink chamber with the first and second recessed surfaces; and a nozzle plate formed on the barrier wall and having a nozzle disposed on a center of the ink chamber;

wherein the nozzle plate is spaced-apart from the base plate by a height between 5 μm and 24 μm inclusive.

27. An ink-jet printhead comprising:

a base plate including a substrate having an outer surface and a recessed surface defining a recess formed on the substrate to a depth from the outer surface, an adiabatic layer formed on the outer surface and the recessed surface and having a portion corresponding to the recess, a heater formed on the adiabatic layer to generate a thermal energy and having a portion corresponding to the recess, and a passivation layer formed on the heater and having a portion corresponding to the recess;

a barrier wall formed on the passivation layer of the base plate to define an ink chamber having a recessed bottom surface corresponding to the recess; and a nozzle plate formed on the barrier wall and having a nozzle corresponding to the ink chamber.

28. The ink-jet printhead of claim 27, wherein the recessed portion comprises:

a side having an inclined surface extended from the outer surface toward an inside of the substrate.

29. The ink-jet printhead of claim 27, wherein the recessed surface comprises:

a rectangular shape having a side having a length of 130 μm.

30. The ink-jet printhead of claim 27, wherein the recessed surface comprises:

one of a circular shape and a polygonal shape.

31. The ink-jet printhead of claim 27, wherein the base plate comprises a conductor formed between the heater and the passivation layer and having a portion defining an opening corresponding to the recess, and the passivation layer is formed on the conductor and the heater through the opening of the conductor.

32. The ink-jet printhead of claim 31, wherein the portion of the passivation layer comprises a first recessed surface and a second recessed surface disposed within the first recessed surface, and the first recessed surface and the second recessed surface correspond to the conductor and the recess, respectively.

33. The ink-jet printhead of claim 32, wherein the barrier wall comprises a sidewall, and the ink chamber is defined by the sidewall of the barrier wall, the first recessed surface, the second recessed surface, and the nozzle plate.

* * * * *